United States Patent [19]

Nakaoji et al.

[11] Patent Number: 4,706,891

[45] Date of Patent: Nov. 17, 1987

[54] PROCESS FOR PRODUCING HIGH CONCENTRATION COAL-WATER SLURRY

[75] Inventors: Kazuhiko Nakaoji, Ichihara; Mitsugu Kamao, Chigasaki; Hayami Itoh, Himeji; Shuhei Tatsumi; Shoichi Takao, both of Akashi, all of Japan

[73] Assignees: Lion Corporation; Kao Corporation; Mitsui Engineering and Shipbuilding Company Limited; Electric Power Development Company Limited, all of Tokyo; Kawasaki Jukogyo Kabushiki Kaisha, Hyogo, all of Japan

[21] Appl. No.: 893,446

[22] Filed: Aug. 7, 1986

Related U.S. Application Data

[63] Continuation of Ser. No. 446,603, Dec. 3, 1982, abandoned.

[30] Foreign Application Priority Data

Dec. 3, 1981 [JP] Japan ..... 56-194775

[51] Int. Cl.[4] ..... B02C 19/12

[52] U.S. Cl. ..... 241/16; 44/51; 241/21; 241/24; 241/29

[58] Field of Search ..... 44/51, 1 R, 1 B; 241/24, 29, 21, 16, 81, 153, 137, 170, 1, 80, 97, 30, 26, 284

[56] References Cited

U.S. PATENT DOCUMENTS

| | | | |
|---|---|---|---|
| 2,826,370 | 3/1958 | Weston | 241/81 X |
| 3,497,142 | 2/1970 | Nelson | 241/29 X |
| 3,773,268 | 11/1973 | Bond | 241/284 X |
| 4,265,407 | 5/1981 | Kessler et al. | 241/21 |
| 4,274,599 | 6/1981 | Maneroy et al. | 241/16 |
| 4,282,006 | 8/1981 | Funk | 44/51 |
| 4,288,166 | 9/1981 | Nakabayashi et al. | 241/24 X |
| 4,498,906 | 2/1985 | Scheffee | 44/51 |

FOREIGN PATENT DOCUMENTS

| | | | |
|---|---|---|---|
| 50412 | 4/1982 | European Pat. Off. | 241/21 |
| 2752902 | 5/1979 | Fed. Rep. of Germany | 241/21 |

*Primary Examiner*—Mark Rosenbaum

*Attorney, Agent, or Firm*—Wenderoth, Lind & Ponack

[57] ABSTRACT

A high-concentration coal-water slurry of a coal concentration as high as 71 percent by weight at a viscosity of 2,000 cp (at 25° C.) can be produced by first coarsely crushing a starting coal, further pulverizing 95 to 30 percent by weight of the coarsely crushed thus obtained, subjecting the finely pulverized coal thus obtained, together with the remainder of the coarsely crushed coal, to crushing in a wet-type crusher, and pulverizing and adjusting the coal particles to a particle size constitution of 20 to 30 percent by weight of 200-mesh size and larger and 80 percent by weight or less of 350-mesh size and smaller.

6 Claims, 5 Drawing Figures

PROCESS FOR PRODUCING HIGH CONCENTRATION COAL-WATER SLURRY

This application is a continuation of now abandoned application Ser. No. 446,603 filed Dec. 3, 1982.

BACKGROUND OF THE INVENTION

This invention relates to a process for producing a coal-water slurry of high concentration of coal by reducing the particle size of the coal (hereinafter referred to generally as "pulverizing" and sometimes as "crushing" or "grinding") in a specific manner.

The process of mixing pulverized coal with water and rendering the mixture into a high-concentration slurry which is of low viscosity whereby transfer thereof by pumping is possible, and which, moreover, has a fluidity such that the coal particles will not settle and separate out, in general, is difficult. For this reason, measures such as the addition of additives for facilitating this process have heretofore been resorted to. At the same concentration of a coal-water slurry, a tendency of the slurry viscosity to increase with decrease in the coal particle size is exhibited. For this reason, the preparation of a high-concentration slurry for the purpose of direct combustion is difficult.

As a cumulative result of our research directed toward the objective of producing high-concentration slurries, we have discovered that, by carrying out a specific pulverizing process to finely pulverize coal and thereby to obtain a specific particle-size constitution or distribution, it is possible to further increase the coal concentration of coal-water slurries having fluidity which have heretofore been obtained.

SUMMARY OF THE INVENTION

This invention, which has been developed on the basis of this discovery, seeks to provide a process for producing a high-concentration slurry of coal in water which, by increasing the concentration of a coal-water slurry, makes possible increase in the efficiency of slurry transportation, direct combustion of the coal-water slurry, and handling of coal as a fluid.

According to this invention, briefly summarized, there is provided a process for producing a high-concentration coal-water slurry which is characterized by the steps of coarsely crushing coal, further pulverizing from 95 to 30 weight percent of the coarsely crushed coal thus obtained, introducing this further pulverized coal together with the remainder of the coarsely crushed coal into a wet-type crusher such as a wet-type ball mill to pulverized and adjust the coal to a particle size constitution of 20 to 30 weight percent of 200 mesh or more and up to 80 weight percent of 350 mesh or less. It is to be noted in this connection that there is a natural limit to the concentration of the coal in a coal-water slurry per se. In order to raise this concentration further, a slurry dispersant such as a surface active agent or surfactant is added according to necessity.

The nature, utility, and further features of this invention will be more clearly apparent from the following detailed description with respect to preferred embodiments of the invention, specific examples of practice thereof, and comparisons of slurries produced by the conventional art and according to this invention, when read in conjunction with the accompanying drawings, briefly described below.

DETAILED DESCRIPTION OF THE INVENTION

Throughout the following description, quantities (amounts) expressed in percent (%) are by weight unless specified otherwise.

Figure 1:
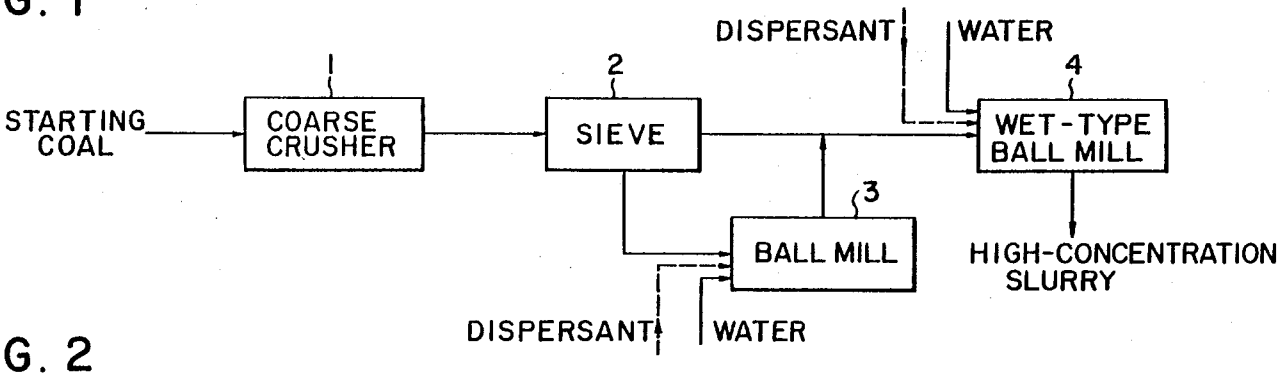
FIGS. 1, 2, and 3 are flow-chart process diagrams respectively indicating preferred embodiments of the process according to this invention.

Referring first to FIG. 1 illustrating a first embodiment of this invention, starting coal is coarsely crushed in a coarse crusher 1, and thereafter the coal thus coarsely crushed is classified by sieving with a classifier such as a sieve 2. The fraction passing through this sieve 2 is finely pulverized in a crusher such as a ball mill 3, which may be either of wet type or dry type, a slurry dispersant being added to the coal in the case of a wet-type ball mill. The finely pulverized coal thus obtained, while being mixed with the fraction not passing through the sieve 2 or with the fraction not passing through the sieve 2 and a dispersant, is introduced into a wet-type crusher such as a wet-type ball mill 4, wherein the resulting mixture is pulverized and adjusted so as to have a particle size constitution of, for example, 20 to 30% of 200-mesh and up to larger size and 80% or less of 350-mesh and smaller size.

More specifically, pulverizing and adjustment are carried out in the ball mill 4 to obtain a particle size constitution of 20 to 30% of 200-mesh and larger, 80 to 40% of 350-mesh and up to smaller, and 30% of 200- to 350-mesh. A particle size constitution of 20 to 30% of 200-mesh or larger, 80 to 70% of 350-mesh or smaller, and 10% of 200-mesh to 350-mesh may also be used.

In the case where the coarsely crushed coal contains a large quantity of fine particles, if the fraction passing through the sieve is introduced into and pulverized in a pulverizing machine such as the ball mill 3, the particles will become all the more excessively fine, whereby the required quantity of the dispersant will increase, which is objectionable for reasons of cost. For this reason, in such a case, the fraction not passing through the sieve is introduced into and finely pulverized in a pulverizing machine such as the ball mill 3, and, as the fraction passing through the sieve with or without water and the dispersant are mixed, the resulting mixture is introduced into a wet-type pulverizing machine such as a wet-type ball mill. As a result, the quantity of ultra-minute particles (a number of $\mu$m or smaller) can be kept small, and the surface area of the coal particles is thereby made small, whereby the quantity of the dispersant added can be reduced.

A slurry dispersant to be used in this invention comprises at least one surface active agent or surfactant suitably selected from anionic, nonionic, and cationic surfactants, used singly or in combination, depending on the kind of coal.

Specific examples of such anionic surfactants are fatty oil sulfate, higher alcohol sulfate, nonionic ether sulfate, olefin sulfate,alkyl allyl sulfonate, dicarboxylate sulfonate, dialkyl sulfo succinate, acyl sarcosinate, alkyl benzene sulfonate, alkyl sulfate, polyoxyethylene alkyl (alkyl phenol) sulfate, alkyl phosphate, salts of esters of dialkyl sulfo succinic acid, acrylic acid and/or maleic anhydride copolymer, polycyclic aromatic sulfonate, formalin compounds.

Specific examples of cationic surfactants are salts of alkyl amines and salts of quaternary amines, alkyltrimethyl ammonium chloride, alkyl dimethyl benzyl ammonium chloride and salts of alkylpyridium Specific examples of nonionic surfactants are polyoxyalkyl ether, polyoxyethylene alkyl phenol ether, oxyethylene.oxypropylene blockpolymer, polyoxyethylene alkyl amine, sobitan fatty acid ester, polyoxyethylene solbitan fatty acid ester, polyoxyethylene fatty acid ester, fatty alcohol polyoxyethylene ether, alkyl phenol polyoxyethylene ether, polyhydric alcohol fatty acid ester, ethanolamide fatty acid.

As amphoteric surfactants, alkyl betaine and the like as well as amine compounds such as 1,2,3,-monoamines and diamines and higher alkylamino acids and the like are used. The quantity of the dispersant to be added is 0.01 to 3 percent, preferably 0.3 to 1.5 percent relative to that of the coal.

Figure 2:
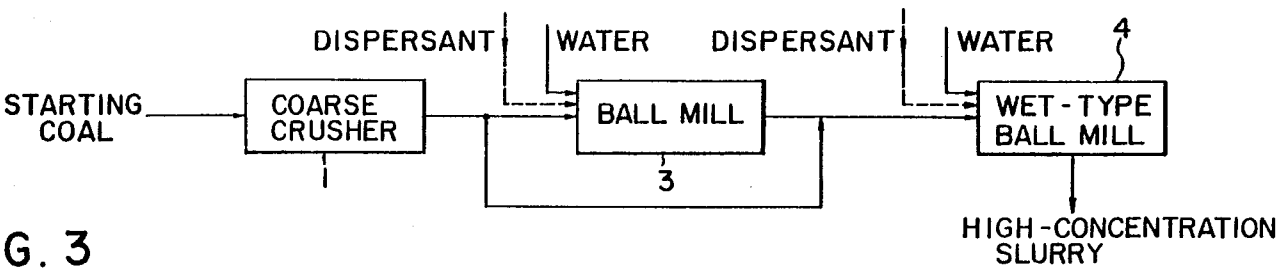

In another embodiment of this invention as indicated in FIG. 2, the process comprises coarsely crushing the starting coal in a coarse crusher 1, then finely pulverizing one portion (95 to 30%, preferably 90 to 50%, more preferably 80 to 60%) of the coarsely crushed coal in a crusher such as a ball mill 3 (which may be of either the wet type or dry type, a dispersant and water being added in the case of the wet type), and, as the finely pulverized coal thus obtained is mixed with the remainder of the coarsely crushed coal or with this remainder and a dispersant and water, introducing the resulting mixture into a wet-type crusher such as a wet-type ball mill 4, where it is finely pulverized to a specific particle size constitution, thereby to produce a high-concentration coal-water slurry having fluidity.

Figure 3:
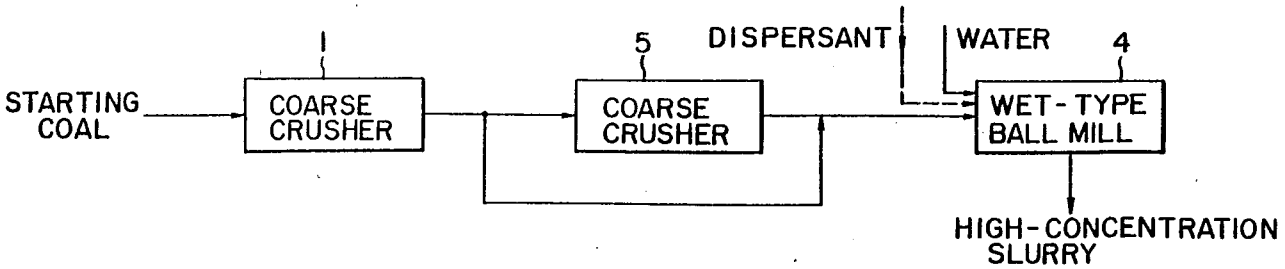

In still another embodiment of this invention as indicated in FIG. 3, the process comprises coarsely crushing the starting coal in a coarse crusher 1, thereafter coarsely grinding one portion (95 to 30%, preferably 90 to 50%, more preferably 80 to 60%) of the coarsely crushed coal again in a separate coarse crusher 5, and, as the coarsely ground coal thus obtained is mixed with the remainder of the coarsely crushed coal with or without a dispersant and water, introducing the resulting mixture into a wet-type crusher such as a wet-type ball mill 4, where it is finely pulverized to a specific particle size consititution, thereby to produce a high-concentration coal-water slurry having fluidity.

In order to indicate more fully the nature and utility of this invention, the following specific examples of practice thereof are set forth, it being understood that these examples are presented as illustrative only and are not intended to limit the scope of the invention.

EXAMPLE 1

Starting coal for testing of the properties set forth in the following table was coarsely crushed to particle sizes of approximately 4 mm or smaller (30% of 1 mm and greater, 10% of 2 mm and greater, and 1% of 4 mm and greater) in a coarse crusher and was then divided by means of a sieve with 1-mm openings. The fraction passing this sieve was 70%. This fraction, together with a dispersant and water in a quantity of 1% relative to the coal of the fraction, was finely pulverized in a wet-type ball mill to sizes of 48 mesh or smaller. In this case, the fraction of 200-mesh size or smaller was 70%.

Then, as this finely pulverized coal and the fraction not passing the above mentioned sieve of 1-mm openings were mixed, the resulting mixture was supplied into a wet-type ball mill and finely pulverized, and a high-concentration coal-water slurry was prepared. The slurry was found to have a solid concentration of 70%, a viscosity of 1,000 cp (at 25° C.), and a particle-size constitution comprising 25% of 200-mesh and large size, 5% of 200- to 350-mesh, and 70% of 350-mesh and smaller size.

| Properties of starting coal for testing | |
|---|---|
| Moisture content: | 7.2% |
| Ash content: | 8.9% |
| Volatile matter content: | 28.2% |
| Fixed carbon: | 60.0% |
| Fuel ratio: | 2.13 |
| Elementary analysis | |
| C | 77.9 |
| H | 4.5 |
| O | 7.0 |
| N | 0.9 |
| S | 0.7 |
| Calorific value | 7,450 kcal/kg |

EXAMPLE 2

The same starting coal for testing as in Example 1 was coarsely crushed to sizes of approximately 4 mm or smaller (of the same particle size constitution as in Example 1). A 80-percent portion of the coarsely crushed coal, together with a dispersant and water in a quantity of 1% relative to the coal in that portion, was finely pulverized to sizes of 48-mesh and smaller size in a wet-type ball mill. In this case, the fraction of 200-mesh and smaller size was 70%.

Then, as the coal finely pulverized in this ball mill and the remainder (20%) of the above mentioned coarsely crushed coal were mixed, the resulting mixture was fed into and finely pulverized in a wet-type ball mill to prepare a high-concentration coal-water slurry. This slurry had a concentration of 70%, a viscosity of 1,000 cp (at 25° C.), and a particle size constitution of 25% of 200-mesh and greater size, 5% of 200- to 350-mesh size, and 70% of 350-mesh and smaller size.

EXAMPLE 3

The same starting coal for testing as in Example 1 was coarsely crushed to sizes of approximately 4 mm or smaller (of the same particle size constitution as in Example 1). A 70-percent portion of the coarsely crushed coal was again coarsely ground to particle sizes of approximately 1 mm and smaller (of a particle size constitution of 30% of 0.4-mm and greater size, 15% of 0.8-mm and greater size, and 5% of 1-mm and greater size).

Then, as this coarsely ground coal was mixed with the remainder of the coarsely crushed coal of particle sizes of approximately 4-mm and smaller size and a dispersant in a quantity of 1% relative to the coal, the resulting mixture was supplied into and finely pulverized in a wet-type ball mill thereby to prepare a high-concentration coal-water slurry. This slurry had a concentration of 70%, a viscosity of 1,000 cp (at 25° C.), and a particle size constitution of 25% of 200-mesh and greater size, 3% of 200- to 350-mesh size, and 72% of 350-mesh and smaller size.

Figure 4:
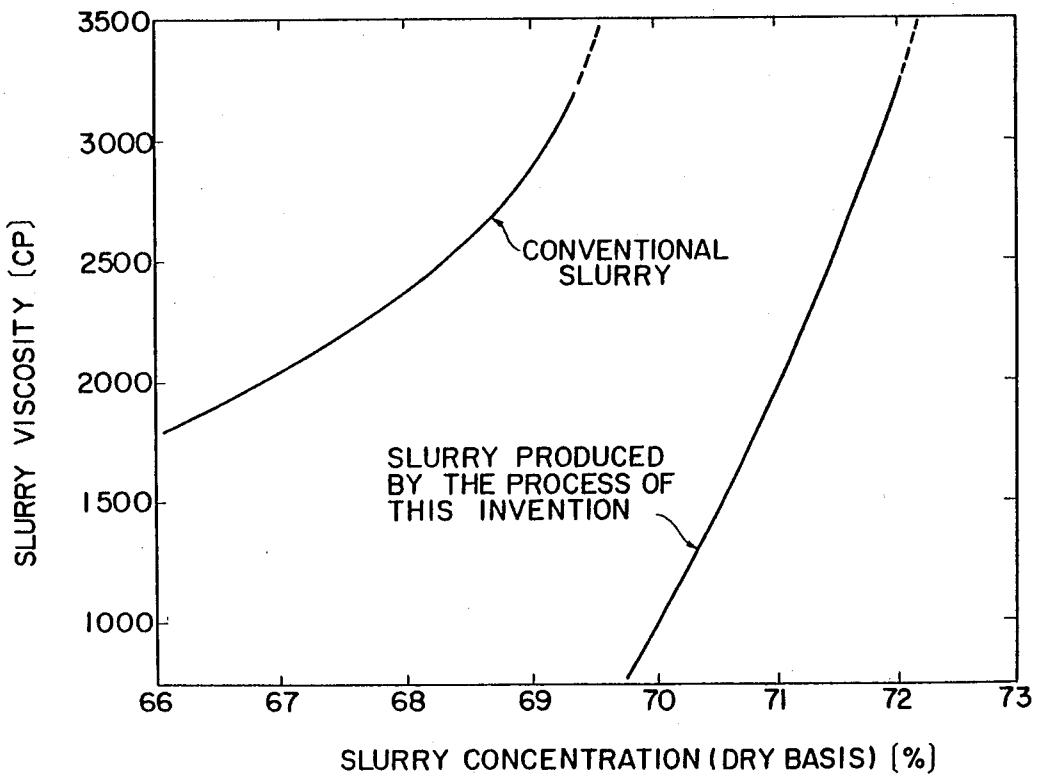
FIG. 4 is a graph indicating relationships of slurry concentration and viscosity respectively of a conventional slurry and of a slurry produced by the process of the invention.

The effectiveness of the process of this invention is indicated in FIG. 4, which is a graph, based on actual test measurements, showing the relationships between slurry concentration and slurry viscosity (at 25° C.) for a coal-water slurry prepared by a conventional process and that prepared by the process of this invention. It is apparent from FIG. 4 that, at a slurry viscosity of 2,000 cp, for example, the coal concentration of the conventionally prepared slurry is approximately 67% while the coal concentration of the slurry prepared by the process of this invention is approximately 71%, which is approximately 4% higher than the former concentration.

Figure 5:
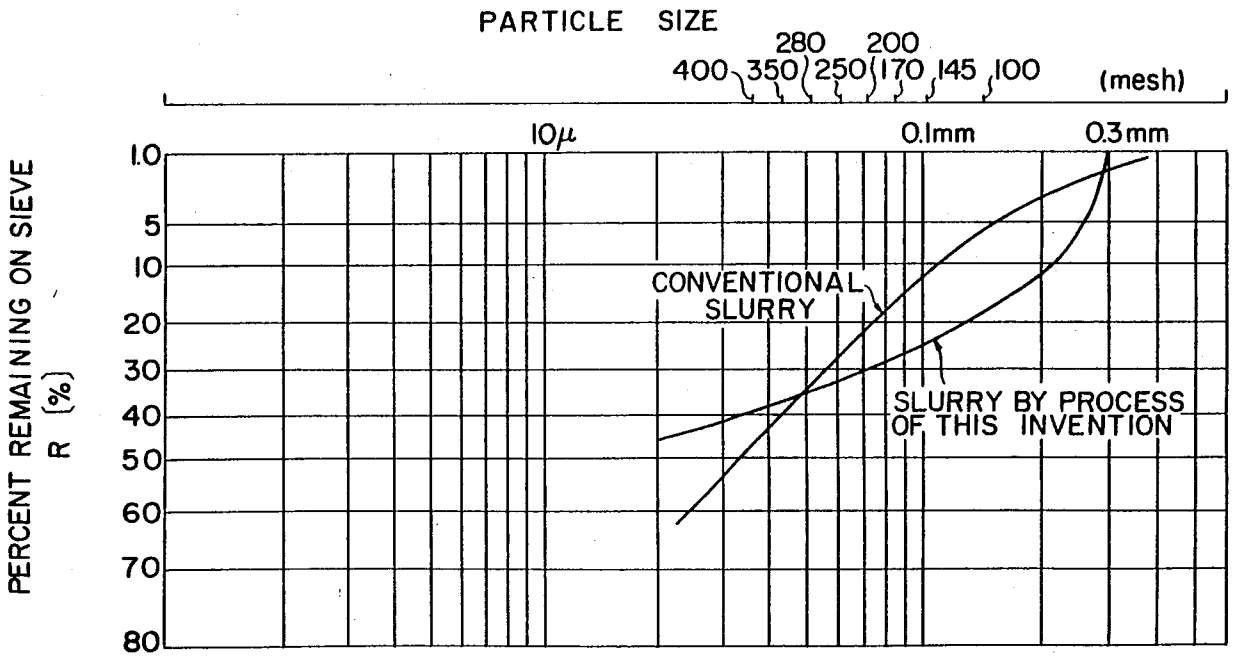
FIG. 5 is a graph indicating the particle size constitutions or distributions respectively of a conventional slurry and of a slurry produced by the process of the invention.

Furthermore, the particle size constitutions of the conventional slurry and of the slurry prepared by the process of this invention, also based on actual test measurements, are compartively shown in FIG. 5. In this case, 1% of a dispersant was added to each of these slurries. It is apparent from FIG. 5 that the 200- to 350-mesh fraction is of a great amount in the conventionally slurry, whereas it is of relatively small amount in the slurry prepared by the process of this invention.

A particle size constitution of this nature can be readily obtained in accordance with this invention by first coarsely crushing the starting coal, thereafter further pulverizing 95 to 30 percent, preferably 90 to 50 percent, more preferably 80 to 60 percent of the coarsely crushed coal, introducing the finely pulverised coal thus obtained, together with the remainder of the coarsely crushed coal, into a wet-type ball mill, and finely pulverizing the mixture. In the above described fine pulverization of the coarsely crushed coal and in the mixing of the finely pulverized coal obtained with the remainder of the coarsely crushed coal, a dispersant can be added according to the necessity.

As described above, by combining at least one coarsely crushing step with at least one fine pulverizing step in a specific manner according to this invention, the coal particle fraction of particle sizes between 200 and 350 mesh can be made relatively small in the particle size constitution, and the limiting concentration of the high-concentration slurry can be elevated by a number of percent above the concentrations attainable in the prior art.

Accordingly, increase in slurry transportation efficiency, direct combustion of slurrry, and the handling of coal as a fluid become possible. Furthermore, by using a wet-type ball mill, coal can be finely pulverized to a desired particle size distribution, and, at the same time, the coal, water, and a dispersant in a quantity of 1 percent relative to the coal can be uniformly mixed, various benefits such as reduction in the number of mixing and preparation steps for the coal-water slurry being afforded.

What we claim is:

1. A process for producing a high-concentration coal-water slurry by pulverizing coal, which comprises first coarsely crushing a starting coal so that the substantial portion of the coal particles coarsely crushed will have a particle size of approximately 4 mm. or smaller, further pulverizing 95 to 30 percent by weight of the coarsely crushed coal thus obtained into a finely pulverized coal of a particle size such that major portion of the particles finely crushed will pass a 200-mesh screen, subjecting the finely pulverized coal thus obtained, together with the remainder of the coarsely crushed coal, to crushing in a wet-type crusher, and pulverizing and adjusting the coal particles to a particle size constitution of 20 to 30 percent by weight of 200-mesh size and larger, up to 80 percent by weight of 350-mesh size and smaller and up to 30 percent by weight of a 200–350-mesh size.

2. The process according to clai 1 in which a slurry disperssant is added to the step of crushing in a wet-type crusher.

3. The process according to claim 2 in which the dispersant is a member selected from the group consisting of anionic, nonionic, and cationic surface active agents, and mixture thereof.

4. The process according to claim 2 in which the dispersant is used in a quantity of 0.01 to 3 percent by weight relative to the coal.

5. The process according to claim 1 in which 90 to 50 percent by weight of the coal thus coarsely crushed is further pulverized, and the finely pulverized coal thus obtained is introduced, together with the remainder of the coarsely crushed coal, into a wet-type crusher.

6. The process according to claim 1 in which, of the coal particles in the high-concentration coal-water slurry, 20 to 30 percent by weight is of 200-mesh or larger size, up to 80 percent by weight is of 350-mesh or smaller size, and up to 10 percent by weight is of 200-mesh to 350-mesh size.

* * * * *